US006605336B2

(12) United States Patent
Ichinose et al.

(10) Patent No.: US 6,605,336 B2
(45) **Date of Patent: *Aug. 12, 2003**

(54) RECORDING MEDIUM AND RECORDING METHOD USING THE SAME

(75) Inventors: Hirofumi Ichinose, Tokyo (JP); Masako Ichioka, Tokorozawa (JP)

(73) Assignee: Canon Kabuskiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/329,314

(22) Filed: Jun. 10, 1999

(65) Prior Publication Data

US 2002/0197452 A1 Dec. 26, 2002

(30) Foreign Application Priority Data

Jun. 15, 1998 (JP) ..... 10-167296

(51) Int. Cl.[7] ..... B41M 5/00; B41J 2/01
(52) U.S. Cl. ..... 428/195; 347/105
(58) Field of Search ..... 428/195, 328, 428/329

(56) References Cited

U.S. PATENT DOCUMENTS

| | | | | |
|---|---|---|---|---|
| 4,460,637 A | * | 7/1984 | Miyamoto et al. | 428/212 |
| 5,374,475 A | | 12/1994 | Wälchli | 428/304.4 |
| 5,955,185 A | * | 9/1999 | Yoshino et al. | 428/195 |

FOREIGN PATENT DOCUMENTS

| | | |
|---|---|---|
| EP | 0 743 193 A1 | 11/1996 |
| JP | 58-136482 | 8/1983 |
| JP | 59-222381 | 12/1984 |
| JP | 62-111782 | 5/1987 |
| JP | 2-276670 | 11/1990 |
| JP | 4-101880 | 4/1992 |
| JP | 7-232473 | 9/1995 |
| JP | 7-232474 | 9/1995 |
| JP | 7-232475 | 9/1995 |
| JP | 7-237348 | 9/1995 |

OTHER PUBLICATIONS

E.P. Barrett, et al., "The Determinations of Pore Volume and Area Distribution in Porous Substances. I. Computations from Nitrogen Isotherms", J. Amer. Chem. Soc., vol. 73, Jan.–Mar. 1951, pp. 373–380.

E.W. Washburn, "Note on a Method of Determining the Distribution of Pore Sizes in a Porous Material", Proc. Natl. Acad. Sci., vol. 7, 1921, pp. 115–116.

* cited by examiner

*Primary Examiner*—Pamela R. Schwartz
(74) *Attorney, Agent, or Firm*—Fitzpatrick, Cella, Harper & Scinto

(57) ABSTRACT

Provided is a recording medium provided with a porous ink-receiving layer containing thermoplastic resin particles and an inorganic pigment laminated on a substrate, wherein the pore radius distribution curve of said porous ink-receiving layer has a maximum peak in a pore radius range of from 1 $\mu$m to 10 $\mu$m and at least one peak in a pore radius range of from 0.001 $\mu$m to 0.1 $\mu$m and the total volume of pores having radii of from 0.1 $\mu$m to 20 $\mu$m is not less than 0.5 $cm^3/g$.

11 Claims, 1 Drawing Sheet

RECORDING MEDIUM AND RECORDING METHOD USING THE SAME

BACKGROUND OF THE INVENTION

1. Field of the Invention

The present invention relates to a recording medium provided with a porous ink-receiving layer laminated on the substrate and a method for conducting a record thereon by an ink-jet system.

The ink-jet recording system is a system of ejecting minute ink droplets by various operating principles and depositing them to a recording medium such as paper to make a record of images, characters or the like, has features that high speed, low-noise and multi-color recording can be easily realized and a compatibility in recording pattern is high without need for development or fixation, and then has rapidly been spreading in various uses. Furthermore, according to the multi-color ink-jet recording system, there can be formed multi-color images, which are almost equal in quality as compared with a color print according to the color photography process or a multi-color print according to the plate making process, and recorded articles can be obtained at lower cost than those by a usual multi-color printing or print in case of a small number of copies, and therefore the multi-color ink-jet recording system is being widely applied to the field of full-color image recording.

2. Related Background Art

With the request for improvement in recording characteristics, such as speedier, more precise and fully-colored records, an ink-jet recorder and recording method have so far been improved, but at the same time high level characteristics have been required for a recording medium to be used.

According to the ink-jet recording system, an ink comprising a large amount of a solvent such as water or a mixture of water and an organic solvent is used from the need for ejecting ink droplets from a nozzle toward a recording medium at high speed. Thus, to obtain an recorded image having a high color density, a large amount of ink must be used. Besides, since ink droplets are continuously ejected, there may occur a beading phenomenon in which ink dots are joined, causing disorder in an image. To prevent this beading phenomenon, a large amount and a high speed of ink absorption in a recording medium is required.

Such being the case, many types of recording media with a porous layer comprising inorganic particles such as alumina hydrate formed on the substrate as described in Japanese Patent Application Laid-Open No. 2-276670 have been proposed to improve the absorbency, coloration and resolution. Furthermore, a recording medium with an ink fixing layer comprising a transparent resin soluble or swellable in the solvent of an ink formed on the substrate as described in Japanese Patent Application Laid-Open No. 4-101880 has been proposed.

Furthermore, to improve an ink-absorbency, there has been proposed a recording medium with two upper and lower porous particle layers having different pore radii and comprising porous inorganic particles and binder as described in Japanese Patent Application Laid-Open No. 62-111782.

Besides, a recording medium with a porous polymer layer (mixture layer of organic particles and inorganic particles) formed on a porous alumina layer by applying and drying a dispersion comprising a polymer latex having an average particle diameter of from 0.05 to 0.5 $\mu$m and inorganic particulates such as silica particles has been also proposed as described in Japanese Patent Application Laid-Open No. 7-237348.

On the other hand, to improve a resolution while retaining an ink-absorbency, a recording medium having two peaks in a pore radius distribution curve has been also proposed as described in Japanese Patent Publication No. 63-22997.

Also, with the ink-jet recording system, there has often been used an ink of such a type as dissolving the dye component into a solvent thus far. However, since the dyestuff ink is poor in light fastness and ozone-resistance by nature, a long-term storage of recorded documents has brought about a problem of fading or discoloring. Thus, there has been proposed a method in which recording is conducted on a recording medium provided with a porous layer comprising a thermoplastic resin material on the substrate and then a porous layer is fused under an action of heat or pressure to make the recording medium denser, as described in Japanese Patent Application Laid-Open No. 58-136482 and U.S. Pat. No. 5,374,475. Still more, there has been also proposed a recording medium provided with a two-layered ink-receiving layer in which an inorganic pigment layer having a large ink-absorptivity is provided on the substrate and a top surface layer comprising a thermoplastic organic polymer is provided, as described in Japanese Patent Publication No. 2-31673.

However, these background arts have the following problems.

In a recording medium with porous layer comprising inorganic particles as described in Japanese Patent Application Laid-Open No. 2-276670, neither sufficient light fastness nor ozone-resistance is obtained when using a dyestuff ink.

Besides, a recording medium with an ink fixing layer using a resin soluble or swellable in an ink solvent as described in Japanese Patent Application Laid-Open No. 4-101880 has a problem of being slow in drying of ink and sticky for a while after the completion of recording.

Also, with a recording medium with a two-layered ink-receiving layer as described in Japanese Patent Application Laid-Open No. 62-111782, an ink-absorbency can be improved, but defects in the adjustment of coating conditions and drying conditions for obtaining the uniformity of a coated film or the reduction in fault of a coated film occur in the step of forming the two layers, causing not a few problems in production.

Further, according to a recording medium with a porous polymer layer formed as a upper layer of a two-layer construction by using a polymer latex and inorganic particulates as described in Japanese Patent Application Laid-Open No. 7-237348, an ink-absorbency can be further promoted, but the two layer construction also makes it difficult to obtain a uniform coated film. Particularly, defects such as cracks or fissures may occur. Furthermore, when using a large amount of ink, no sufficient examination has been made on what porous construction the porous polymer layer should be composed of.

Still also, in a recording medium having two peaks in a pore radius distribution curve as described in Japanese Patent Publication No. 63-22997, the pore radius distribution curve has two peaks due to pores by voids formed between the aggregates of primary particles of 0.2 $\mu$m or below in diameter and due to pores in the particles themselves. Here, the pores are so set as to increase the pore volume having small radii of 0.05 $\mu$m or below. In case of using a photo ink rich in solvent and surfactant to promote the gradation in a half tone or the like under recent circumstances of requiring a photographic tone, no sufficient absorbency is always obtained with a pore structure as mentioned above. Namely, an ink-absorbency due to voids having a larger peak pore radius becomes further needed, but in the formation of a pore, formed between the aggregates of very small primary particles, it is difficult to form a greater amount of pores having a sufficiently large peak radius. Accordingly, when a higher speed printing than achieved by a conventional printing method is required, or for a decrease in the number of printing passes, no sufficient absorbing power for ink has been obtained.

And, according to a method in which recording is conducted on a recording medium provided with a porous layer comprising a thermoplastic resin material and then the porous layer is fused to make the recording medium denser, as described in Japanese Patent Application Laid-Open No. 58-136482 and U.S. Pat. No. 5,374,475, problems of fading or the like of dyestuff ink can be solved, but when the formation of a denser record image is needed, the ink-absorbency remains yet insufficient.

And also, in a two-layered recording medium as described in Japanese Patent Publication No. 2-31673, problems on production remain as with the above two-layered recording medium.

SUMMARY OF THE INVENTION

The present invention has been accomplished in consideration of the problems of the individual background art described above.

An object of the present invention is to provide a recording medium which causes neither bleeding nor flood, which is high in an absorbing power and which is capable of obtaining an excellent gradation, even when using an ink-jet printer with a great amount of ink supplied and using a diluted ink overlappingly plural times of recording or using a diluted ink and a thick ink in combination for acquiring a higher gradation, and further which can exhibit a sufficient absorbing power also in a high-speed printing for a decrease in the number of printing passes, and also which does not necessary to select the type of a substrate, is easy in production, is preventable in the fading of a record image, and is capable of widely coping with using environments, taking the water-fastness into consideration.

An another object of the present invention is to provide a recording method capable of performing good recording to the recording medium.

The above objects can be achieved by the present invention described below.

According to the present invention there is provided a recording medium provided with a porous ink-receiving layer containing thermoplastic resin particles and inorganic pigments laminated on the substrate, wherein the pore radius distribution curve of the above porous ink-receiving layer has a maximum peak in a pore radius range of from 1 $\mu$m to 10 $\mu$m and at least one peak in a pore radius range of from 0.001 $\mu$m to 0.1 $\mu$m and the total volume of pores having pore radii of from 0.1 $\mu$m to 20 $\mu$m is not less than 0.5 $cm^3/g$.

According to the present invention there is also provided a recording method for depositing an ink to the porous ink-receiver layer of the recording medium by the ink-jet system.

DESCRIPTION OF THE PREFERRED EMBODIMENTS

Figure 1:
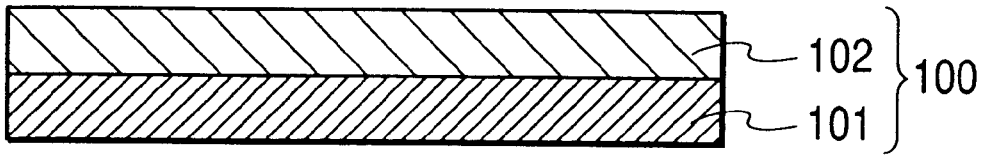
FIG. 1 is a schematic sectional view showing one example of a recording medium according to the present invention.

FIG. 1 is a schematic sectional view showing one example of a recording medium according to the present invention. A recording medium 100 comprises a porous ink-receiving layer 102 laminated on a substrate 101.

As the substrate 101, various members known since former days can be used without any restriction. For example, various plastics such as polyesters such as polyethylene terephthalate, polycarbonates and fluorine resins such as ETFE; specially treated paper such as printing paper used for silver salt photograph, baryta paper and resin coat paper; and surface-processingless paper such as plain paper can be mentioned.

The porous ink-receiving layer 102 has pores by voids formed by the mutual fusion of thermoplastic resin particles and contains a porous inorganic pigment. For the purpose of making a record to this recording medium 100, it is only necessary to supply an ink onto the porous ink-receiving layer 102, so that the solvent component of the ink passes through pores. In the present invention, pores by voids formed by the fusion of these thermoplastic resin particles bear the major role of passage and absorption for the solvent component of ink.

The size and volume of a pore in the porous ink-receiving layer 102 is made proper by fulfilling the conditions that the pore radius distribution curve has a maximum peak in a pore radius range of from 1 $\mu$m to 10 $\mu$m and at least one peak in a pore radius range of from 0.001 $\mu$m to 0.1 $\mu$m and the total volume of pores having radii of from 1 $\mu$m to 20 $\mu$m is not less than 0.5 $cm^3/g$.

Unlike a conventional recording medium, the pore radius distribution curve of the porous ink-receiving layer 102 in a recording medium 100 according to the present invention has a maximum peak on a pore radius range of from 1 $\mu$m to 10 $\mu$m. By forming such pores of relatively large radius, the porous ink-receiving layer 102 manifests an excellent absorbency and permeability for ink even when making a record requiring a high image density, or for a great amount of used ink, thereby enabling flood or bleed of ink to be prevented. If the maximum peak of the pore radius distribution curve exists in a pore radius range of below 1.0 $\mu$m, use of ink rich in solvent component disables a rapid passage and absorption of ink through pores, thus resulting in defects such as bleeding. On the other hand, if the maximum peak of this pore radius distribution curve exists in a radius range of above 10 $\mu$m, the strength of porous ink-receiving layer 102 decreases, a clearness of a recorded image lowers and no smooth surface is obtained in heating and fusion after the completion of recording.

The pore radius distribution in the porous ink-receiving layer 102 is obtained by calculating differential curve from the void volume distribution curve [Urano, "Hyomen" (Surface), 13 (10), p. 588 (1975) and Onogi, Yamanouchi and Imamura, Kamipa Gikyo-shi (Journal of Japan TAPPI), 28, p. 99 (1974)] by the mercury injection method [refer to literatures such as E. A. WASHIBURN, Proc. Natl. Acad. Sci. 7. p. 115 (1921)]. In this case a pore radius can be calculated by using the method of Barrett et al. [refer to J. Am. Chem. Soc. 73. p373 (1951)].

In the porous ink-receiving layer 102, the total volume of pores having radii of from 0.1 $\mu$m to 20 $\mu$m is not less than 0.5 $cm^3/g$, preferably not less than 2.0 $cm^3/g$. By setting the total volume of pores at or above 0.5 $cm^3/g$, a sufficient passing and absorbing operation of a solvent component in ink can be obtained.

Such a pore structure of the porous ink-receiving layer 102 can be formed by appropriately adjusting the type and particle diameter of an employed thermoplastic resin, the type and particle diameter of a porous inorganic pigment and relations of a mixing ratio between thermoplastic resin and a porous inorganic pigment, dry conditions and film thickness.

As simple and easy method for forming pores by voids by the mutual fusion of thermoplastic resin particles, for example, a method comprising the steps of applying a coating liquid containing thermoplastic resin particles and porous inorganic pigments to the substrate 101 and forming a porous ink resin layer 102 by drying can be mentioned. The thermoplastic resin particles employed here may be, for example, dispersion or suspension in the aqueous or non-aqueous phase, or colloidal particle in colloidal solution by solvent or water.

As resin materials composing thermoplastic resin particles, there may be mentioned polyolefine resins such as low molecular weight polyolefine, low density polyolefine and vinylactate polyolefine, polyurethanes, polyesters, styrene-acrylic copolymers, polyacrylates, polymethacrylates. However, they are not limited to these resins, but modifications of these resins and copolymers of other monomers are usable. As regards thermoplastic resin particles, one type may be simply used or a mixture of different types may be used according to the need.

The shape of thermoplastic resin particles may be a shape as permits pores to be formed by the mutual fusion of particles, is not limited to a strict sphere and may be needle-like. However, from the standpoint of capable of forming a porous ink-receiving layer 102 having more uniform pores, a shape near to a true sphere is preferable.

Among all thermoplastic resin particles used for forming a porous ink-receiving layer 102, at least a part of them has preferably particle diameter within a range of from 1 to 100 $\mu$m. In particular, 50% or more of all thermoplastic resin particles have particle diameter preferably within a range of from 1 to 100 $\mu$m and especially preferably within a range of from 2 to 20 $\mu$m. Such particle diameter within a range of from 1 to 100 $\mu$m is greater than particle diameter of resin particles used in the porous resin layer of the background art. By using thermoplastic resin particles of particle diameter in the range of from 1 to 100 $\mu$m, very large pores can be easily created in the porous ink-receiving layer 102. Incidentally, measurement of the particle diameter is according to the Coulter counter method.

The minimum film-forming temperature of thermoplastic resin particles lies preferably in a range of from 40° C. to 150° C. and more preferably in a range of from 50° C. to 130° C. The minimum film-forming temperature means a minimum temperature permitting a uniform film to be formed when heating a film formed from resin particles. To form a porous ink-receiving layer 102, resin particles must be fused between them, for example, by heating and drying them to form a pore structure meeting the above individual conditions. Excessive fusion of thermoplastic resin particles leads to the formation of a dense film, whereas insufficient fusion disables a sufficient film strength to be obtained. Accordingly, the heating and drying must be done under such conditions that resin particles are fused and combined so as not to form a dense film but has a definite film strength. Here, if the minimum film-forming temperature is not lower than 40° C., it is difficult for resin particles to form a dense film on heating and drying and a pore structure meeting the above individual conditions is easily obtained. And because of no need for lowering the dry temperature, the solvent or the like in the film after the completion of coating is easily dried and only a short drying time is required. On the other hand, if the minimum temperature is not higher than 150° C., no very high heat treatment temperature is required in need of melting the porous resin layer by heating after the completion of recording and a problem is unlikely to occur that heating may cause the color materials such as dyes in the substrate or ink to be deformed, decomposed, oxidized or colored.

A VICAT softening point of thermoplastic resin particles lies preferably in a range of from 10° C. to 120° C. and more preferably in a range of from 30° C. to 80° C. When the VICAT softening point is not higher than 80° C., a film can be rapidly densified in need of melting the porous resin layer by the heating after the completion of image formation. On the other hand, when not lower than 30° C., a sufficiently hard film can be easily obtained.

In the present invention, the porous ink-receiving layer 102 contains a porous inorganic pigment. This porous inorganic pigment can compensate the absorbing power of pores formed by the mutual fusion of thermoplastic resin particles and can also bear the role of catching or fixing a coloring material such as dyestuff in ink. This inorganic pigment is preferably disposed in pores formed by the mutual fusion of thermoplastic resin particles and at the fused portions thereof by a uniform dispersion.

Examples of porous inorganic pigments include calcium carbonate, kaolin, talc, calcium sulfate, barium sulfate, titania, zinc oxide, zinc carbonate, aluminum silicate, alumina hydrates, silicic acid, sodium silicate, magnesium silicate, calcium silicate, silica and the like. All of these can be used alone or as a mixture.

In particular, from the standpoint of image aptitude such as an ink-absorbency and a resolution, silica and alumina hydrates are preferable. As silica, natural silica, synthetic silica, amorphous silica and the like or a chemically modified silica compound are preferable. In particular, positively charged silica is preferable.

Besides, because alumina hydrate is positively charged, it is so high in the fixation of dyes in an ink that a highly glossy and well colored image can be obtained, moreover becomes high in transparency at a lower haze than observed in an ink-receiving layer using another pigment, and therefore it is very preferable as a pigment used for the ink-receiving layer. The alumina hydrate, for example, is expressed in terms of the following general formula:

$$Al_2O_{3-n}(OH)_{2n}\cdot mH_2O$$

wherein n represents any one of integers 0, 1, 2 or 3 and m represents a value of 0 to 10, preferably 0 to 5, provided that m and n are not 0 at the same time.

Here, since $mH_2O$ represents a removable water phase mostly taking no part in the formation of a crystal lattice, m can take a fractional value. Besides, on calcining such type of alumina hydrate, m may reach a value of 0.

As preferable alumina hydrate, there is amorphous alumina hydrate found on the analysis by the X-ray diffraction method. Especially, the alumina hydrate described in Japanese Patent Application Nos. 5-125437, 5-125438, 5-125439 and 6-114571 is preferable.

With respect to the particle diameter of a porous inorganic pigment, the average particle diameter of secondary or tertiary aggregates formed by the mutual aggregation of primary particles having average particle diameter of from 0.002 μm to 0.05 μm lies preferably within a range of from 0.1 μm to 10 μm.

The average pore radius of a porous inorganic pigment lies preferably in a range of from 0.005 μm to 0.05 μm. By using a porous inorganic pigment having such an average pore radius, pores other than those of gaps formed by the mutual fusion of thermoplastic resin particles can be created, so that the pore radius distribution curve of the porous ink-receiving layer 102 has at least one peak in a radius range of from 0.001 μm to 0.1 μm. By the provision of at least one peak in this range, the fixation of a dyestuff can be improved.

Here, by setting the average particle diameter of secondary or tertiary aggregates of an inorganic pigment to 0.1 to 1 times the average particle diameter of thermoplastic resin particles, the pores due to a porous inorganic pigment in the porous ink-receiving layer 102 are controlled within the above-mentioned range after the completion of fusion of thermoplastic resin particles between them and the functional separation between pores by gaps formed by the mutual fusion of thermoplastic resin particles and pores due to a porous inorganic pigment, thereby enabling both the absorbing power for an ink and the resolution to be promoted.

Besides, in the present invention, an even disposition of gaps formed by the mutual fusion of thermoplastic resin particles and a porous inorganic pigment is important. To be specific, an even disposition and content of a porous inorganic pigment in part of gaps formed by the mutual fusion of thermoplastic resin particles in the porous ink-receiving layer 102 permits the fixing power to be exhibited by other pores formed by the porous inorganic pigment.

As a method for forming a porous ink-receiving layer 102, for example, there can be mentioned a method comprising the steps of mixing thermoplastic resin particles and a porous inorganic pigment and applying and drying a liquid mixture suspended in water or a solvent as a coating liquid onto the substrate 101. Here, the mixing ratio of thermoplastic resin particles to a porous inorganic pigment lies preferably in a range of from 55:45 to 95:5 by weight. If the fraction of thermoplastic resin particles is made not less than 55%, the above large pores for an ink-absorption becomes easy to obtain. On the other hand, if the fraction of thermoplastic resin particles is made not more than 95%, the mechanical strength of the porous ink-receiving layer 102 can be improved, so that cracks and powdery splitting become difficultly to occur.

To a coating liquid obtained by mixing thermoplastic resin particles and a porous inorganic pigment, a dispersant, thickener, pH modifier, lubricant, fluid denaturant, surfactant, defoaming agent, water-proofing agent, foam inhibitor, releasing agent, soot-proofing agent or the like may be added within the limits of not damaging the object of the present invention.

The coating liquid can be applied onto the substrate 101, for example, by the blade coat process, the air knife coat process, the roll coat process, the flash coat process, the gravure coat process, the kiss coat process, the die coat process, the extrusion process, the slide hopper (slide beat) process, the curtain coat process, the spray process or the like.

An amount of the coating liquid onto the substrate 101 has only to be selected appropriately corresponding to uses or the like of the desired recording medium. Namely, by moderately thickening a porous ink-receiving layer 102, desired pores can be formed in this layer 102, thus enabling the bleeding or the like of ink to be well prevented. On the other hand, by moderately thinning it, the strength of the layer 102 can be promoted, occurrence of a film fault can be prevented at the time of coating and drying, a sufficient absorbed amount of ink can be secured on the whole, a transparency of a recorded article can be secured and a clearness of an image is hard to damage. In general, from the standpoint of securing the absorbed amount and retaining the strength of a whole film, the thickness of a porous ink-receiving layer 102 (after the drying) lies preferably in a range of from 10 to 200 μm.

By subjecting the coating layer provided on the substrate 101 to a drying treatment by heating according to the need, a porous ink-receiving layer 102 is obtained. By this drying treatment, an aqueous solvent (dispersant) is evaporated and at the same time a film formation takes place by the mutual fusion and combination of thermoplastic resin particles. The conditions for drying treatment have only to be determined appropriately corresponding to the composition of the coating liquid employed. For example, a hot-air drying furnace, an IR drying furnace or the like employed generally can be used alone or in combination.

A recording medium according to the present invention is very suitable especially for a recording method using the ink-jet recording system, but can be used also for a recording process using another type of ink.

As for a recording medium according to the present invention, those on which a record is made by applying ink to the porous ink-receiving layer 102 may be used as a recorded article as it is, or those in which the porous ink-receiving layer 102 is fused and densified by heating (and under pressure) after applying ink and making a record may be used as a recorded article.

In a case that a recorded article by applying ink is employed as it is, a raggedness remains on a film surface of the porous ink-receiving layer 102, so that a recorded article having a touch resembling a matted paper surface in appearance can be obtained. In this case, it is effective for the provision of water-resistance to soak the porous ink-receiving layer 102 with a water-proofing agent or with a cationic substance in advance. Furthermore, by controlling a water repellency in a surface of the porous ink-receiving layer 102, the water-resistance can be afforded effectively. For example, by using the olefine resin mentioned above or the like as thermoplastic resin particles, the water repellency of the relevant surface can be controlled. In the case of affording the water-resistance by controlling the water repellency, the degree of water repellency in the top surface of the porous ink-receiving layer evaluated by the water repellency test method of JIS P 8137 is set preferably to a range of from R7 to R10.

In particular, with a recorded article with an image recorded on a recording medium using a paper substrate, swelling, deformation or the like of paper itself occurs even though ink does not bleed when water are contacted with the surface, but the above provision of water-resistance enables such problems to be evaded, so that use as poster to be attached outdoors becomes also possible.

Figure 2:
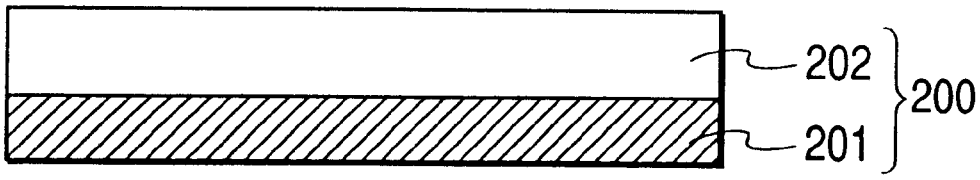
FIG. 2 is a schematic sectional view showing one example of a recorded article obtained by densifying the ink-receiving layer after making a record to a recording medium according to the present invention.

When the porous ink-receiving layer 102 is molten by heating (and under pressure) after applying an ink, a recorded article 200 with a densified film surface formed on the substrate 201 is obtained as shown in FIG. 2. By this densification, the surface of the recorded film can be smoothed.

For this heat treatment, a hot-air drying furnace, an IR drying furnace, a hot plate or the like generally employed can be used alone or in a combination without any restriction. Heating has only to be performed from the surface, the back surface or both surface of a recording medium. Besides, a pressure treatment may be jointly conducted at the time of the heat treatment. In this case, since melting by the heat treatment is accelerated by a pressure treatment, densification of resin is accelerated, thus enabling the treatment to be accomplished in a shorter time.

As the heat treatment and pressure treatment, a method comprising passing an object through a roll-like hot roll used for laminate or the like and thereafter passing the object through a cooling roll can be mentioned. If the surface of this roll is made into a mirror surface, a smoother surface can be obtained, whereas a matted surface can be obtained if a shape is given to the surface of the roll.

Besides, the degree of water repellency in the top surface of the porous ink-receiving layer after this heating (and pressurizing), or that of the densified resin layer 202, is preferably R9 or R10.

By melting pores of the porous ink-receiving layer 102 in this manner, a coloring material in an ejected ink is firmly fixed, so that characteristics in durability such as light fastness, ozone-resistance and water-fastness are greatly promoted.

Hereinafter, referring to examples, the present invention will be described in further detail, but the present invention is not limited to these examples. Incidentally, the notation "%" in the description means a ratio by weight.

EXAMPLE 1

A recording medium according to the present invention having the construction shown in FIG. 1 was prepared as follows.

First of all, aluminum dodeoxide was hydrolyzed to obtain alumina slurry. Next, water was added to this slurry till the solid component of alumina hydrate reaches 7.9%, a 3.9% aqueous solution of nitric acid was further added to adjust pH and a colloidal sol was obtained through an aging step. Then, this colloidal sol was spray-dried at 75° C. to obtain an alumina hydrate. At that time, an average pore radius of the alumina hydrate was 0.007 $\mu$m. This measurement was performed using Omnisorp 360 (available from COULTER Co.). This alumina hydrate was dispersed into ion exchange water to make a 15% alumina dispersion.

On the other hand, a low-density polyethylene emulsion (Chemipearl M 200: trade name, available from Mitsui Chemical Co., Ltd.; average particle diameter: 6 $\mu$m; VICAT softening point: 76° C.) was diluted with ion exchange water in advance to make a 20% aqueous solution. This 20% aqueous solution was mixed with the 15% alumina dispersion prepared before and agitated to obtain a coating liquid in a dispersing state. In this coating liquid, the weight ratio (solid component) of resin particles (thermoplastic resin particles) of the emulsion to the alumina hydrate (porous inorganic pigment) was 80:20.

Next, using a coating machine and a drying furnace, the coating liquid was die-coated on woodfree paper (substrate 101) having a basic weight 64 g/m$^2$ and dried at 50° C. to form a 40 $\mu$m thick porous ink-receiving layer 102. Thus, a recording medium 100 with a porous ink-receiving layer 102 laminated on the substrate 101 (FIG. 1) was obtained.

With respect to the porous ink-receiving layer 102 of this recording medium 100, its pore radius distribution was measured using the mercury injection method after forming the relevant layer on a PET film and vacuum-drying it for over 24 hours under vacuum. Here, AUTOPORE III 9420 (available from MICROMERITICS Co.) was used for the measurement. As a result, a maximum peak of the pore radius distribution curve existed at the position of 2.03 $\mu$m in radius. Besides, one peak existed at the position of 0.002 $\mu$m in radius. The total volume of pores having a radius range of from 0.1 to 20 $\mu$m was 0.67 cm$^3$/g.

EXAMPLE 2

Except that silica powder was employed in place of alumina hydrate as porous inorganic pigment and after ejecting a cationic resin was added to the coating liquid to make an impacted ink water-proof, a recording medium 100 was prepared in the same manner as in Example 1.

Here, a 10% dispersion of silica powder prepared by dispersing silica powder (P78A; trade name; available from Mizusawa Chemical Co., Ltd.; average pore radius: 0.0087 $\mu$m) into ion exchange water was used and mixed with a 20% aqueous solution of low-density polyethylene emulsion identical with that used in Example 1, a cationic resin (Cation BB; trade name, available from Nippon Oil and Fat Co., Ltd.) was added to the coating liquid in an amount of 3% relative to the whole coating liquid and the mixture was agitated to obtain a coating liquid in dispersion. In this coating liquid, the weight ratio of particles (thermoplastic resin articles) to silica powder (porous inorganic pigment) was 90:10. The thickness of the porous ink-receiving layer 102 after dried was 38 $\mu$m.

With respect to the porous ink-receiving layer 102 of this recording medium 100, its pore radius distribution was measured similarly. As a result, a maximum peak of the pore radius distribution curve existed at the position of 2.31 $\mu$m in radius. Besides, one peak existed at the position of 0.025 $\mu$m in radius. The total volume of pores having a radius range of from 0.1 to 20 $\mu$m was 1.71 cm$^3$/g.

COMPARATIVE EXAMPLE 1

Except that a liquid mixture of alumina hydrate and polyvinyl alcohol, water-soluble resin, was employed as coating liquid for forming a porous ink-receiving layer and the drying temperature after the die-coating was modified, a recording medium was prepared in the same manner as in Example 1.

Here, the alumina dispersion similar to that of Example 1 was employed and a 10% solution prepared by dissolving polyvinyl alcohol (Gohsenol NH 18; trade name; available from Nihon Gosei Kagaku Kogyo Co., Ltd.) into ion exchange water was used. In this coating liquid, the weight ratio (solid component) of polyvinyl alcohol (thermoplastic resin particles) to alumina hydrate (porous inorganic pigment) was 10:90. Besides, the drying temperature after die-coating was set to 120° C. The thickness of the porous ink-receiving layer after dried was 38 $\mu$m.

With respect to the porous ink-receiving layer of this recording medium, its pore radius distribution was measured similarly. The pore radius distribution curve had only one peak at the position of 0.11 $\mu$m in radius.

EVALUATION OF EXAMPLES 1 AND 2 AND COMPARATIVE EXAMPLE 1

To individual recording medium obtained in Examples 1 and 2 and Comparative Example 1, printing was conducted using an ink-jet printer (BJC-430J; trade name; available from CANON Inc.) with an ink (BC-22e; trade name; available from CANON Inc.) being set and a shot-in amount of the ink was adjusted to 200%, 300% and 400% and the recording medium was evaluated on the following items (1) to (5). The results are shown in Table 1.

(1) Film Quality

The film surface after drying a coated film was observed using an optical microscope (10 to 100 times in magnitude). Those without any crack or fissure were ranked as "A" and those with crack or fissure were ranked as "C".

(2) Ink Absorbing Rate (Drying Property)

After the printing, the elapsed time in which fingers were not polluted even when brought into slight touch with the printed portion of a recorded article (an amount of single ink: 400%) prior to the fixation was measured and those within 10 seconds, those within 60 seconds and the others polluted after 60 second were ranked as "A", "B" and "C", respectively.

(3) Absorbing Power (Bleeding and Beading)

After the printing, the printed portion of a recorded article after the completion of fixation was observed, the presence of occurrence of bleeding and beading was confirmed and those of no occurrence at 400%, those of no occurrence at 300%, those of no occurrence at 200% and those of occurrence at 200% were ranked as "AA", "A", "B" and "C", respectively.

(4) Water Repellency (Water-resistance)

According to the water repellent degree testing method of JIS P 8137, a state of water drops on the recording medium was observed to evaluate the water repellent degree.

(5) Optical Density of Image (O.D.) after treatment

After the printing, the optical density of image in the printed portion of a fixed recorded article (an amount of single ink: 400%) was measured from the printing side by using a Macbeth Densitometer RD-918.

Here, as for "judgment in evaluation", a judgment of "Passed" was made when there is no evaluated result of "C" in any evaluation items (1) to (3), the water repellent degree is not lower than R7 and the optical density of image is not lower than 1.5 in the evaluation item (5) "Optical Density of Image after treatment".

TABLE 1

| Evaluation Item | Example 1 | Example 2 | Comparative Example 1 |
|---|---|---|---|
| (1) Film Quality | A | A | C (partially) |
| (2) Ink Absorbing Rate | A | A | B |
| (3) Ink Absorbing Power | A | A | B |
| (4) Water repellency | R8 | R8 | R6 |
| (5) Optical Density of Image after treatment | 1.85 | 1.80 | 1.84 |
| Judgement in Evaluation | Passed | Passed | Failed |

In Examples 1 and 2, good results were obtained concerning individual evaluation items as shown in Table 1 and a judgment of "Passed" was made comprehensively. On the other hand, in Comparative Example 1, cracks and fissures were recognized in a part of film and no better result was obtained concerning the ink absorbing rate, the ink absorbing power and the water repellency and a judgment of "failed" was made comprehensively.

EXAMPLES 3 TO 6 AND COMPARATIVE EXAMPLES 2 TO 3

Except that the ratio of thermoplastic resin particles to a porous inorganic pigment is modified to 100:0, 95:5, 80:20, 70:30, 55:45 and 40:60 in Example 1, each recording medium 100 was prepared in the same manner as in Example 1.

With respect to the porous ink-receiving layer 102 of the recording medium 100, its pore radius distribution was measured in the same manner as in Example 1. And the recording medium 100 was evaluated on the following items (1) to (5). The results are shown in Table 2.

TABLE 2

| | Comparative Example 2 | Example 3 | Example 4 | Example 5 | Example 6 | Comparative Example 3 |
|---|---|---|---|---|---|---|
| Ratio | 100:0 | 95:5 | 80:20 | 70:30 | 55:45 | 40:60 |
| Max. Peak Position ($\mu$m) | 2.14 | 2.15 | 2.03 | 1.98 | 1.90 | 0.98 |
| Total Volume of Pores in a range of 0.1–20 $\mu$m ($cm^3/g$) | 0.68 | 0.69 | 0.67 | 0.60 | 0.52 | 0.41 |
| Peak Positions Other Than Max. Peak | — | 0.010 | 0.021 | 0.023 | 0.032 | 0.052 |
| (1) Film Quality | B | A | A | A | B | C (Partially) |
| (2) Ink Absorbing Rate | A | AA | A | A | B | B |
| (3) Ink Absorbing Power | C | B | A | A | A | B |
| (4) Water Repellency | R9 | R8 | R8 | R7 | R7 | R6 |
| (5) Optical Density of Image | 1.45 | 1.80 | 1.85 | 1.82 | 1.75 | 1.51 |
| Evaluation Judgment | Failed | Passed | Passed | Passed | Passed | Failed |

EXAMPLE 7 AND ITS EVALUATION

To the recording medium 100 obtained in Example 1, printing using an ink-jet printer was made as with the above evaluation methods, the printed medium was thereafter charged into a hot-blast drying furnace and the porous ink-receiving layer 102 was densified for one minute kept at 120° C. to obtain a recorded article 200 (FIG. 2).

To the recorded article 200, a water repellency test according to JIS P 8137 was made concerning the above evaluation item (4) "Water Repellency". The result revealed a water repellent degree of R10.

Next, to evaluation the light fastness and the ozone-resistance, the following evaluation item "Store Stability" was added.

(6) Shelf Stability (Light Fastness and Ozone-resistance)

A printed and fixed recorded article 200 was exposed in a room for three months and the discoloring degree (fading) was examined. Those of completely no change, those of somewhat fading and those of completely fading were ranked as "A", "B" and "C", respectively.

The evaluation result of the recorded article 200 concerning the shelf stability was "A".

EXAMPLE 8 AND COMPARATIVE EXAMPLE 4

To the recording medium 100 obtained in Example 1 and Comparative Example 1, printing was made using a printer variable in printing speed (not shown), or variable to 4 passes, 3 passes, 2 passes and 1 pass in the number of printing passes and Evaluation item (2) "ink absorbing rate" was evaluated.

The results are shown in Table 3. In a recording medium 100 according to the present invention, the ink absorption was good even in a speedier case of printing rate.

TABLE 3

| Number of Passes | Example 8 | Comparative Example 4 |
|---|---|---|
| 4 passes | A | A |
| 3 passes | A | B |
| 2 passes | A | C |
| 1 pass | A | C |

According to the present invention, as described above, it is possible to provide a recording medium in which discoloring of a recorded image is prevented, the water-resistance and shelf stability are good, neither bleeding nor flood occurs even when a large amount of ink is used for the purpose of acquiring an image high in color density and further the absorption is good also for high-speed printing such as reduced number of printing passes.

Besides, the ink-receiving layer of this recording medium can be constructed in one layer and accordingly is easy in production.

Furthermore, the restriction in the type of a substrate can be loosened.

Also, according to the present invention, it is possible to provide a recording method for forming a good recorded image as mentioned above.

What is claimed is:

1. A recording medium provided with a one-layered porous ink-receiving layer containing pores composed of voids formed by mutual fusion of thermoplastic resin particles and a porous inorganic pigment formed on a substrate, wherein 50% or more of all of said thermoplastic resin particles have a particle diameter within a range of from 1 to 100 $\mu$m, and the average particle diameter of aggregates of said porous inorganic pigment is 0.1 to 1 times the average particle diameter of said thermoplastic resin particles, and wherein a pore radius distribution curve of said porous ink-receiving layer has a maximum peak in a pore radius range of from 1 $\mu$m to 10 $\mu$m and at least one peak in a pore radius range of from 0.001 $\mu$m to 0.1 $\mu$m and the total volume of pores having radii of from 0.1 $\mu$m to 20 $\mu$m is not less than 0.5 $cm^3/g$.

2. The recording medium according to claim 1, wherein the weight ratio of said thermoplastic resin particles to said inorganic pigment lies in a range of from 55:45 to 95:5.

3. The recording medium according to claim 1, wherein the VICAT softening point of said thermoplastic resin particles lies in a range of from 30° C. to 80° C.

4. The recording medium according to claim 1, wherein said thermoplastic resin particles are polyolefin resin particles.

5. The recording medium according to claim 1, wherein the average pore radius of said inorganic pigment lies in a range of from 0.005 $\mu$m to 0.05 $\mu$m.

6. The recording medium according to any one of claims 1–5, wherein said substrate is made of paper.

7. The recording medium according to claim 1, wherein said porous ink-receiving layer contains cationic substance.

8. The recording medium according to claim 1, wherein the water repellent degree in the top surface of said porous ink-receiving layer according to the water repellent degree test method of JIS P 8137 is within a range of from R7 to R10.

9. A recording method comprising the step of:

ejecting ink from an ink-jet system onto a recording medium provided with a one-layered porous ink-receiving layer containing pores composed of voids formed by mutual fusion of thermoplastic resin particles and a porous inorganic pigment formed on a substrate, wherein 50% or more of all of said thermoplastic resin particles have a particle diameter within a range of from 1 to 100 $\mu$m, and the average particle diameter of aggregates of said porous inorganic pigment is 0.1 to 1 times the average particle diameter of said thermoplastic resin particles, and wherein a pore radius distribution curve of said porous ink-receiving layer has a maximum peak in a pore radius range of from 1 $\mu$ to 10 $\mu$m and at least one peak in a pore radius range of from 0.001 $\mu$m to 0.1 $\mu$m and the total volume of pores having radii of from 0.1 $\mu$m to 20 $\mu$m is not less than 0.5 $cm^3/g$.

10. The recording method according to claim 9, further comprising heating and/or pressurizing said recording medium after impacting ink to the porous ink-receiving layer.

11. The recording method according to claim 10, wherein the water repellent degree in the top surface of said porous ink-receiving layer according to the water repellent degree testing method of JIS P 8137 is R9 or R10 after heating and/or pressurizing the recording medium.

* * * * *

UNITED STATES PATENT AND TRADEMARK OFFICE

CERTIFICATE OF CORRECTION

PATENT NO. : 6,605,336 B2
DATED : August 12, 2003
INVENTOR(S) : Hirofumi Ichinose et al.

It is certified that error appears in the above-identified patent and that said Letters Patent is hereby corrected as shown below:

Column 1,
Line 40, “an” should read -- a --.

Column 3,
Line 42, “necessary” should read -- require --.

Column 5,
Lines 23 and 25, “polyolefine” should read -- polyolefin --.
Line 24, “polyolefine,” should read -- polyolefin, --.
Line 35, “capable” should read -- capability, --.

Column 7,
Line 23, “difficulty” should read -- unlikely --.

Column 10,
Line 27, “dried” should read -- drying, --.

Column 13,
Line 13, “evaluation” should read -- evaluate --.
Line 34, “speedier case of” should read -- case of speedier --.

Signed and Sealed this

Thirtieth Day of March, 2004

JON W. DUDAS
*Acting Director of the United States Patent and Trademark Office*